US009869218B2

(12) United States Patent
Matsuda et al.

(10) Patent No.: US 9,869,218 B2
(45) Date of Patent: Jan. 16, 2018

(54) SUPERCHARGER MOUNTING STRUCTURE FOR ENGINE

(71) Applicant: Kawasaki Jukogyo Kabushiki Kaisha, Hyogo (JP)

(72) Inventors: Yoshiharu Matsuda, Akashi (JP); Shohei Naruoka, Kakogawa (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 449 days.

(21) Appl. No.: 14/590,888

(22) Filed: Jan. 6, 2015

(65) Prior Publication Data

US 2015/0114364 A1 Apr. 30, 2015

Related U.S. Application Data

(63) Continuation of application No. PCT/JP2013/068915, filed on Jul. 10, 2013.

(30) Foreign Application Priority Data

Jul. 11, 2012 (JP) ..... 2012-155463

(51) Int. Cl.
*F01M 11/02* (2006.01)
*F02B 33/40* (2006.01)
(Continued)

(52) U.S. Cl.
CPC ..... *F01M 11/02* (2013.01); *F01M 1/02* (2013.01); *F01M 5/002* (2013.01); *F01M 11/03* (2013.01);
(Continued)

(58) Field of Classification Search
CPC ..... F01M 11/02; F01M 1/02; F01M 5/002; F01M 11/03; F04D 25/028; F04D 25/02;
(Continued)

(56) References Cited

U.S. PATENT DOCUMENTS 6,105,558 A * 8/2000 Bushling ..... F02B 33/38 123/559.1
6,796,126 B2 9/2004 Hasegawa et al.
(Continued)

FOREIGN PATENT DOCUMENTS

CN 1432721 7/2003
CN 102549250 7/2012
(Continued)

OTHER PUBLICATIONS

Decision of Rejection dated Aug. 30, 2016 for Corresponding Japanese Patent Application No. 2014-524855 with English Language Summary (4 pages).
(Continued)

*Primary Examiner* — Jason Shanske
*Assistant Examiner* — Jason T Newton

(57) ABSTRACT

To provide a supercharger mounting structure for an engine that enables a supercharger to be easily fitted to or removed from an engine main body, the supercharger mounting structure for the engine includes a supercharger including a compressing unit for supplying an intake air under pressure to the engine, a speed increasing unit for increasing the rotational speed of an engine rotary shaft and then transmitting it to the compressing unit and a supercharger casing for accommodating the compressing unit and the speed increasing unit. The supercharger casing is removably fitted to a crankcase of the engine.

10 Claims, 7 Drawing Sheets

(51) Int. Cl.

| | |
|---|---|
| ***F02B 39/04*** | (2006.01) |
| ***F02B 61/02*** | (2006.01) |
| ***F02B 39/12*** | (2006.01) |
| ***F02B 67/10*** | (2006.01) |
| ***F04D 17/10*** | (2006.01) |
| ***F04D 29/62*** | (2006.01) |
| ***F02B 33/34*** | (2006.01) |
| ***F04D 29/054*** | (2006.01) |
| ***F01M 1/02*** | (2006.01) |
| ***F01M 5/00*** | (2006.01) |
| ***F01M 11/03*** | (2006.01) |
| ***F02B 33/00*** | (2006.01) |
| ***F04D 25/02*** | (2006.01) |
| ***F04D 29/60*** | (2006.01) |

(52) U.S. Cl.
CPC ..... *F02B 33/00* (2013.01); *F02B 33/34* (2013.01); *F02B 33/40* (2013.01); *F02B 39/04* (2013.01); *F02B 39/12* (2013.01); *F02B 61/02* (2013.01); *F02B 67/10* (2013.01); *F04D 17/10* (2013.01); *F04D 25/02* (2013.01); *F04D 25/022* (2013.01); *F04D 25/028* (2013.01); *F04D 29/054* (2013.01); *F04D 29/601* (2013.01); *F04D 29/624* (2013.01); *F01M 2011/021* (2013.01); *F01M 2011/022* (2013.01); *F01M 2011/026* (2013.01); *F05D 2220/40* (2013.01)

(58) Field of Classification Search
CPC .... F04D 29/601; F04D 25/022; F04D 29/054; F04D 17/10; F04D 29/624; F02B 33/34; F02B 39/12; F02B 67/10; F02B 61/02; F02B 39/04; F02B 33/40
USPC ..... 123/559.1
See application file for complete search history.

(56) References Cited

U.S. PATENT DOCUMENTS

| | | | | |
|---|---|---|---|---|
| 7,051,824 | B1 * | 5/2006 | Jones | F02B 33/34 123/559.1 |
| 7,469,689 | B1 * | 12/2008 | Jones | F02B 33/40 123/41.31 |
| 7,549,493 | B1 * | 6/2009 | Jones | F02B 33/00 123/559.1 |
| 8,584,783 | B2 | 11/2013 | Saeki et al. | |
| 8,707,931 | B2 | 4/2014 | Arima et al. | |
| 9,127,591 | B2 | 9/2015 | Arima et al. | |
| 9,644,736 | B2 * | 5/2017 | Senda | F16H 63/32 |
| 2003/0121507 | A1 | 7/2003 | Hasegawa et al. | |
| 2005/0085329 | A1 * | 4/2005 | Kawakubo | F16H 57/02 475/219 |
| 2006/0157004 | A1 * | 7/2006 | Gunji | F01L 1/022 123/54.4 |
| 2007/0079796 | A1 * | 4/2007 | Mineo | F02B 67/06 123/198 R |
| 2010/0031935 | A1 | 2/2010 | VanDyne et al. | |
| 2012/0186565 | A1 * | 7/2012 | Arima | F02B 33/40 123/559.1 |
| 2012/0192839 | A1 | 8/2012 | Arima et al. | |
| 2012/0247418 | A1 * | 10/2012 | Tanaka | F01M 1/16 123/196 R |
| 2012/0247904 | A1 * | 10/2012 | Mitsubori | F01M 1/16 192/48.601 |
| 2012/0267182 | A1 | 10/2012 | Saeki et al. | |
| 2013/0025562 | A1 * | 1/2013 | Nagahashi | F01M 5/025 123/196 R |
| 2015/0128745 | A1 * | 5/2015 | Senda | F02B 61/02 74/473.37 |
| 2015/0184585 | A1 * | 7/2015 | Naruoka | F02B 33/40 123/559.1 |
| 2016/0215691 | A1 * | 7/2016 | Watanabe | F02D 35/027 |
| 2017/0114731 | A1 * | 4/2017 | Ichi | F02D 23/00 |

FOREIGN PATENT DOCUMENTS

| | | | | | |
|---|---|---|---|---|---|
| JP | 63-219822 | | | 9/1988 | |
| JP | 02-006289 | | | 1/1990 | |
| JP | 02006289 | A | * | 1/1990 | B62M 7/02 |
| JP | 02024282 | A | * | 1/1990 | B62M 7/02 |
| JP | 02024283 | A | * | 1/1990 | F02B 61/02 |
| JP | 02-070920 | | | 3/1990 | |
| JP | 02070920 | A | * | 3/1990 | F02B 61/02 |
| JP | 02-163539 | | | 6/1990 | |
| JP | 02-264117 | | | 10/1990 | |
| JP | 05-256146 | | | 10/1993 | |
| JP | 09287466 | A | * | 11/1997 | F02B 61/02 |
| JP | 2001233276 | A | * | 8/2001 | B62M 7/02 |
| JP | 2001233277 | A | * | 8/2001 | F02B 61/02 |
| WO | 2011/046096 | | | 4/2011 | |
| WO | WO2011/046098 | | | 4/2011 | |
| WO | WO2011/077898 | | | 6/2011 | |

OTHER PUBLICATIONS

First Office Action dated Jun. 2, 2016 with English Translation of Search Report of First Office Action in corresponding Chinese Patent Application No. 201380036361.5; 8 pages.
Extended and Supplementary Search Report dated Jun. 16, 2016 for corresponding European Patent Application No. 13817301.8; 7 pages.
Second Office Action dated Dec. 30, 2016 for Corresponding Chinese Patent Application No. 201380036361.5 with English Language Summary (6 pages).
Notification of Reason(s) for Rejection dated Feb. 9, 2016 for Japanese Patent Application No. 2014-524855 with English Language Summary (4 pages).
PCT/JP2013/068915 International Search Report, dated Sep. 3, 2013, 2 pages.
PCT Application No. PCT/JP2013/068915 International Preliminary Report on Patentability dated Jan. 22, 2015, 7 pages.
Communication Pursuant to Article 94(3) EPC dated Mar. 30, 2017 for Corresponding European Patent Application No. 13817301.8 (4 pages).

* cited by examiner

SUPERCHARGER MOUNTING STRUCTURE FOR ENGINE

CROSS REFERENCE TO THE RELATED APPLICATION

This application is a continuation application, under 35 U.S.C §111(a) of international application No. PCT/JP2013/068915, filed Jul. 10, 2013, which claims priority to Japanese patent application No. 2012-155463, filed Jul. 11, 2012, the entire disclosure of which is herein incorporated by reference as a part of this application.

BACKGROUND OF THE INVENTION

Field of the Invention

The present invention relates to a supercharger mounting structure with which a supercharger is fitted to a combustion engine that is mounted on an automotive vehicle such as, for example, a motorcycle.

Description of Related Art

In a combustion engine mounted on the automotive vehicle such as, for example, a motorcycle, the use has been known of a supercharger for supplying an outside air into the engine after the latter has been pressurized. In this respect, see, for example, the Japanese patent document 1 listed below. This known supercharger is so configured as to be driven in operative association with rotation of an engine rotary shaft. As a merit to use such configuration, the air intake efficiency of an air intake system is enhanced, and accordingly, the output of the combustion engine is increased.

PRIOR ART LITERATURE

Patent Document 1: JP Laid-open Patent Publication No. 02-163539

The supercharger of the type referred to above has been known in which the use is made of a compressing unit for supplying an intake air under pressure to the combustion engine and a speed increasing unit for increasing the speed of rotation of the engine rotary shaft and then transmitting the increased rotation of the engine rotary shaft to the compressing unit. If the compressing unit and the speed increasing unit are separately mounted on an engine body, the workability of assembling and disassembling of the supercharger is lowered.

SUMMARY OF THE INVENTION

The present invention has been devised to substantially eliminate the foregoing problems and inconveniences and is intended to provide a supercharger mounting structure for the engine, which enables the supercharger to be selectively mounted on and removed from the engine main body.

In order to accomplish the foregoing object, the present invention herein disclosed provides a supercharger mounting structure used to mount a supercharger on the engine, which includes a supercharger made up of a compressing unit to supply an intake air under pressure to the engine, a speed increasing unit to increase the speed of rotation of an engine rotary shaft and then to transmit the increased rotation of the engine rotary shaft to the compressing unit, and a supercharger casing having the compressing unit and the speed increasing unit both accommodated therein, with the supercharger casing being removably fitted to a crankcase of the engine.

According to the present invention, the compressing unit and the speed increasing unit are accommodated within the supercharger casing that is detachably fitted to the crankcase of the engine, to thereby form a single assembly. Accordingly, the supercharger can easily be fitted to or removed from the engine selectively.

In the supercharger mounting structure for the engine referred to above, preferably, the crankcase has an upper portion formed with an opening, and a power of the engine is transmitted to the speed increasing unit by means of a power transmitting member that extends, having been passed completely, through the opening. According to this structural feature, since the power transmitting member extends, having been passed completely, through the opening, in the case that the supercharger is disposed above the crankcase, a power of the engine can be smoothly transmitted to the supercharger by means of a power transmitting member which is disposed at a position axially adjacent to the supercharger.

In a preferred embodiment of the present invention, the supercharger casing may include a casing main body to enclose the upper portion of the crankcase and a compressing unit housing to accommodate therein the compressing unit. In this case, the compressing unit housing preferably has a portion which protrudes downwardly below an undersurface of the casing main body in a condition connected with the casing main body. According to this structural feature, if the compressing housing and the casing main body are separately formed, it is possible to avoid an undesirable increase of the dimension of the casing main body in an up and down direction or vertical direction.

Particularly where the supercharger casing includes the casing main body and the compressing unit housing, the crankcase may have an upper surface including an abutment surface area, that is held in abutment with the casing main body, and a confronting surface area confronting to the compressing unit housing in a direction conforming to an axial direction of the supercharger. The confronting surface area is preferably formed below the abutment surface area. According to this structural feature, since the confronting surface area is formed below the abutment surface area, the amount of projection upwardly from the crankcase of the supercharger can be suppressed while the interference between the upper surface of the crankcase and the compressing unit housing is avoided.

Particularly where the abutment surface area and the confronting surface area are formed in the upper surface of the crankcase, the upper surface of the crankcase referred to above may also include an extension surface area extending from the confronting surface area in an axial direction of the compressing unit towards one side opposite to the abutment surface area. In this case, the extension surface area is preferably formed together with the confronting surface area below the abutment surface area. According to this structural feature, the extension surface area may be used to accommodate, for example, an air intake duct disposed thereon, which duct is fluid connected with the compressing unit.

In another preferred embodiment of the present invention, so that a rotary shaft of the compressing unit may be disposed above the upper surface of the crankcase, the supercharger casing preferably accommodates therein a support unit configured to support the rotary shaft. According to this feature, even if a rotary body of the compressing unit, for example, an impeller is disposed above the crankcase, the interference between the rotary body and the crankcase in the vertical direction can be avoided when the support unit for the rotary shaft is accommodated within the supercharger casing.

In a further preferred embodiment of the present invention, a drive shaft drivingly connected with the engine rotary shaft to drive the supercharger may be supported by the crankcase. In this case, a switching mechanism may be mounted on the drive shaft to switch a power path of the supercharger, and a change drum operable to actuate the switching mechanism through a shift fork may be accommodated within the supercharger casing. According to this structural feature, since the change drum is also accommodated within the supercharger casing, mounting of the change drum can be facilitated.

Where the shift fork is used, the change drum or the shift fork preferably extends, having been passed, through the opening formed in the upper portion of the crankcase. According to this structural feature, since the change drum or the shift fork extend having been passed through that opening, as compared with the disposition of them on a side surface of the crankcase, the change drum and the shift fork can be easily disposed on an inner side of the combustion engine.

Again, where the shift fork and the change drum are used, a shifter drive unit to drive the change drum may be removably fitted to the supercharger casing. According to this structural feature, in a condition prior to the fitting of the shifter drive unit, the shift fork can be engaged in the supercharger casing and, accordingly, the assemblability can be increased.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter, the present invention will be described in detail in connection with preferred embodiments thereof. Before the description of the present invention proceeds, it is to be noted that the terms "left" and "right" used herein are to be understood as nomenclatures used to denote opposite directions or positions as viewed from a vehicle driver then maneuvering the automotive vehicle, respectively.

Figure 1:
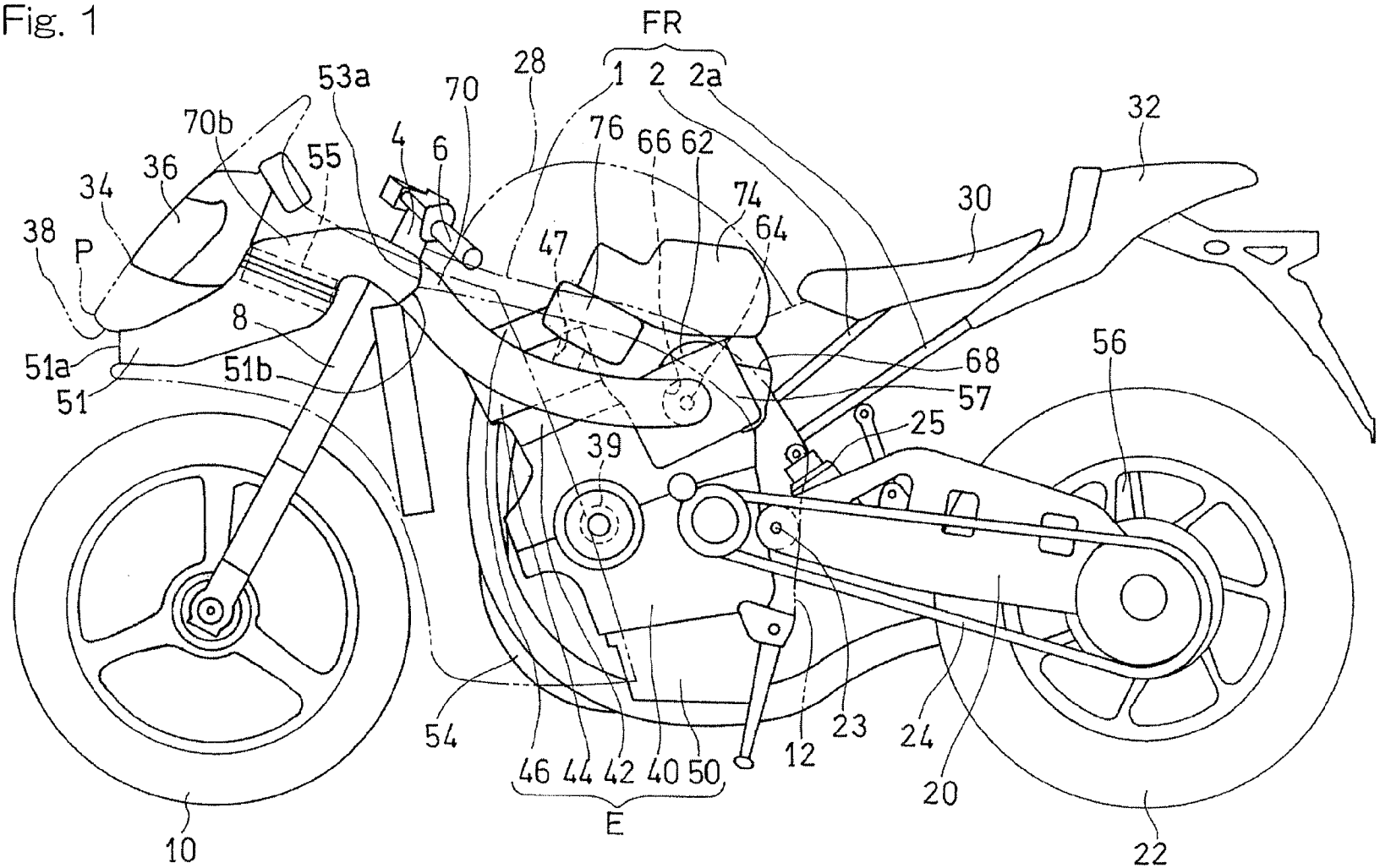
FIG. 1 is a side view of a motorcycle employing a combustion engine of a type equipped with a supercharger mounting structure designed in accordance with a preferred embodiment of the present invention.

FIG. 1 is a side view of a motorcycle, which is one kind of the saddle-riding automotive vehicles and which is equipped with a combustion engine designed in accordance with a referred embodiment of the present invention. The illustrated motorcycle includes a motorcycle frame structure FR made up of a front half frame section and a rear half frame section. The front half frame section includes a main frame 1 and, on the other hand, the rear half frame section includes a rear frame 2 and a reinforcement rail 2*a* both fitted to a rear portion of the main frame 1. The main frame 1 has a front end formed integrally with a head pipe 4, and a front fork 8 is rotatably supported by such head pipe 4 through a steering shaft (not shown). A front wheel 10 is mounted on the front fork 8. That is, the head pipe 4 functions as a handlebar post and the main frame 1, which is a part of the motorcycle frame structure FR, extends from the head pipe 4 in a direction rearwardly of the motorcycle. A handlebar 6 for steering purpose is fixed to an upper end portion of the front fork 8.

On the other hand, a swingarm bracket 12 is provided in a rear end portion of the main frame 1, which is a lower intermediate portion of the motorcycle frame structure FR. A swingarm 20 is supported by the swingarm bracket 12 for movement up and down, and a rear wheel 22 is supported by a rear end portion of the swingarm 20 for pivotal movement about a pivot pin 23. A motorcycle combustion engine E is mounted on the lower intermediate portion of the motorcycle frame structure FR and is positioned on a front side of the swingarm bracket 12. Rotation of the combustion engine E is transmitted to a transmitting mechanism 24 such as, for example, a substantially endless chain, and the rear wheel 22 is driven through this transmission mechanism 24. The combustion engine E is in the form of a parallel multicylinder engine in the form of, for example, a four-cylinder, four-cycle combustion engine. It is, however, to be noted that the type of the combustion engine E is not necessarily limited to that referred to above. A rear portion cushioning mechanism 25, configured to absorb a load between the rear wheel 22 and the rear frame 2, is connected between the rear frame 2 and the swingarm 20.

A fuel tank 28 is disposed on an upper portion of the main frame 1, and a driver's seat 30 and a fellow passenger's seat 32 are supported by the rear frame 2. Also, a front fairing or cowling 34, made of a resinous material, is mounted on a front portion of the motorcycle body so as to cover an area ranging from forwardly of the head pipe 4 to opposite lateral portions of the front portion of the motorcycle body. The front cowling 34 has a headlamp unit 36 mounted thereon, and an air intake opening 38 positioned beneath the headlamp unit 36 for introducing the ambient air therethrough into the combustion engine E is defined in the front cowling 34.

With the air intake opening 38 open in a direction forwardly of the motorcycle body, the amount of air drawn towards the combustion engine E can be increased by the utilization of the wind pressure of the incoming wind A. The air intake opening 38 is disposed in a front surface of the front cowling 34 and is positioned at a nose portion of the front cowling 34 at which the highest wind pressure of the incoming wind is available. In the illustrated embodiment, the air intake opening 38 is shown as positioned below the headlamp unit 38, but it may be positioned above the headlamp unit 36, or at a position intermediate between two headlamps spaced apart from each other in a direction laterally of the motorcycle body in the case of any known twin headlamp structure.

The combustion engine E includes a crankcase 40 for supporting an engine rotary shaft 39 that extends in a direction conforming to the motorcycle widthwise direction, a cylinder block 42 protruding upwardly from the crankcase 40, a cylinder head 44 mounted on the cylinder block 42, a head covering 46 fitted to an upper portion of the cylinder head 44 so as to cover a cam mechanism (not shown) for intake and exhaust valves, and an oil pan 50 provided beneath the crankcase 40. The crankcase 40 has a rear portion concurrently serving as a transmission casing. The cylinder block 42 is somewhat tilted forwardly. The cylinder head 44 has a rear portion provided with an air intake port 47. Four exhaust pipes 54 fluid connected with an exhaust port at a front surface of the cylinder head 44 are merged together at a location beneath the combustion engine E and then fluid connected with an exhaust muffler 56, which is disposed on a right side of the rear wheel 22.

A supercharger 62, which forms an intake unit through which an outside air is drawn and is then supplied towards the combustion engine E, is disposed rearwardly of the cylinder block 42 and above the crankcase 40. This supercharger 62 includes a supercharger rotating shaft 64 extending in a direction parallel to the motorcycle widthwise direction, an air intake port 66 open leftwards at allocation above the crankcase 40, and a discharge port 68 disposed rearwardly of the supercharger rotating shaft 64 in a portion of the combustion engine E intermediate of the motorcycle widthwise direction. The intake port 66 of the supercharger 62 is disposed on an inner side of a left side surface of the cylinder block 42 with respect to the motorcycle widthwise direction, and an air intake duct 70 for introducing the incoming wind A, then flowing forwardly of the cylinder block 42, into the supercharger 62 is fluid connected with the intake port 66.

This air intake duct 70 is disposed on a left side, which is one side of the combustion engine E, and includes a ram duct unit 51 on an upstream side and an air intake duct section 53 on a downstream side. The ram duct unit 51 is supported by the main frame 1 with its front end opening 51*a* facing the air intake opening 38 defined in the previously described cowling 34 and serves to increase the pressure of the air introduced from the front end opening 51*a* under the ram effect. The ram duct unit 51 has a rear end portion 51*b* to which a front end portion 53*a* of the air intake duct section 53.

Figure 2:
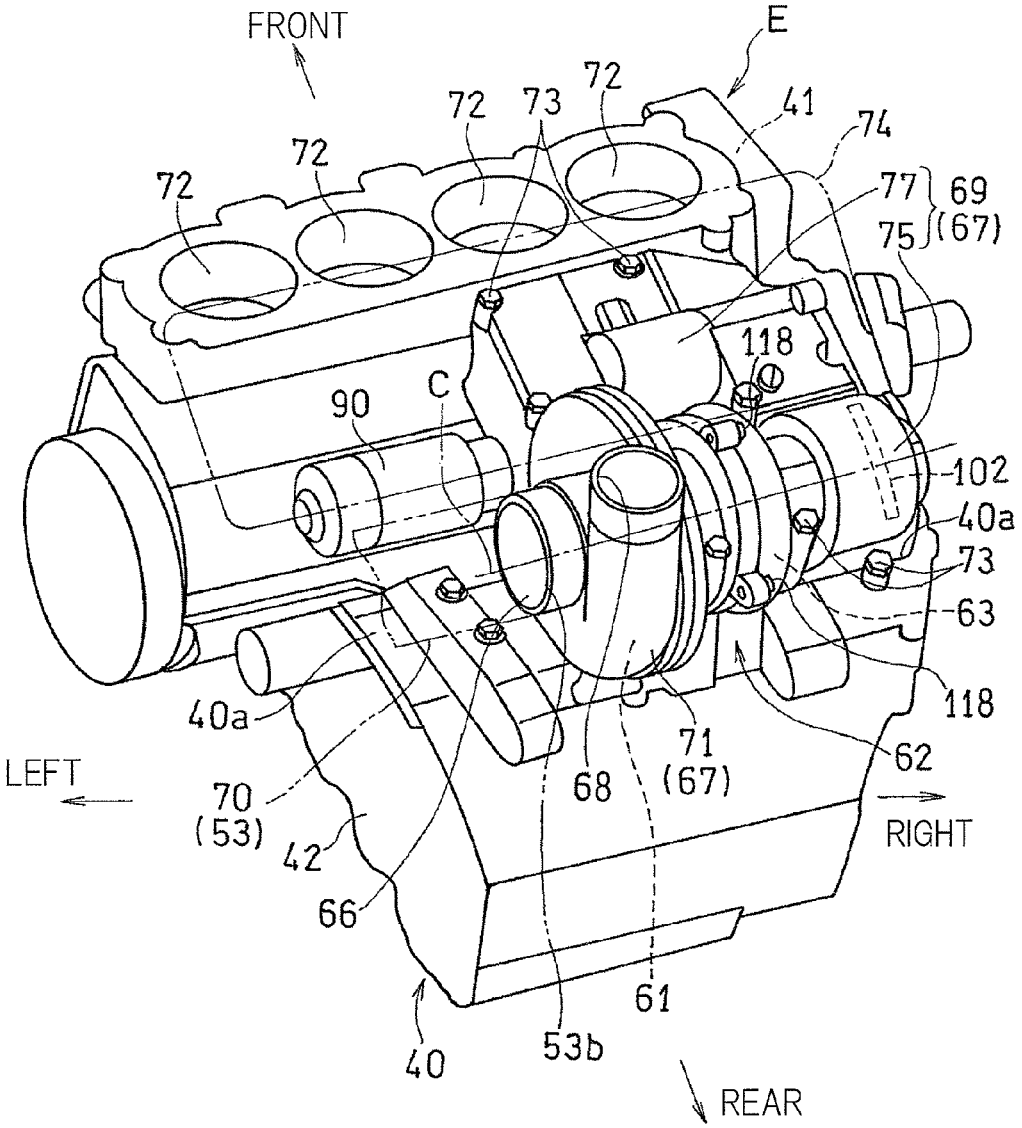
FIG. 2 is a perspective view of the engine, as viewed from rear, shown with a portion thereof removed.

As shown in FIG. 2, the rear end portion 53*b* of the air intake duct section 53 is fluid connected with the air intake port 66 of the supercharger 62. Also, the air cleaner 55 for purifying the air to be introduced into the supercharger 62 is built in a junction between the rear end portion 51 of the ram duct unit 51 and a front end portion 53*a* of the air intake duct section 53. In addition, an air reservoir 57 having a passage surface area set to be greater than that of any other portion of the air intake duct section 53 is formed in a lower end portion of the air intake duct section 53. This air reservoir 57 is positioned rearwardly of the cylinder block 42 and has its outlet fluid connected with the air intake port 66 of the supercharger 62.

The discharge port 68 of the supercharger 62 referred to previously is oriented upwards and, at a location between this discharge port 68 and the four air intake ports 47 (shown in FIG. 1) of the combustion engine E, an intake air chamber 74 is disposed for reserving the intake air supplied from the supercharger 62 and then flowing towards the air intake ports 47. The intake air chamber 74 has a widthwise dimension over the substantially entire length of the combustion engine E in a direction conforming to the motorcycle widthwise direction and is, as shown in FIG. 1, disposed rearwardly of the cylinder block 42 while being positioned above the supercharger 62.

A throttle body 76 is disposed between the intake air chamber 74 and the cylinder head 44. In this throttle body 76, fuel is injected into the intake air to thereby form an air/fuel mixture, which is in turn supplied into respective combustion chambers 72 (shown in FIG. 2) in four cylinder bores of the combustion chamber E through the associated air intake ports 47. Above the intake air chamber 74 and the throttle body 76, the fuel tank 28 referred to previously is disposed.

As shown in FIG. 2, the supercharger 62 referred to above includes a compressing unit 61 for supplying the intake air under pressure to the combustion engine E and a speed increasing unit 63 for increasing the speed of rotation of the engine rotary shaft 39 (shown in FIG. 1) and then transmitting it to the compressing unit 61. The compressing unit 61 and the speed increasing unit 63 are accommodated within a supercharger casing 67, and this supercharger casing 67 is removably fitted to the crankcase 40. The supercharger casing 67 includes a casing main body 69 for covering an upper portion of the crankcase 40 and a compressing unit housing 71 for accommodating therein the compressing unit 61. The casing main body 69 is fitted to an upper surface 40*a* of the crankcase 40 by means of a plurality of bolts 73, and the compressing unit housing 71 is connected with the casing main body 69 by means of a housing fastening member 118.

The compressing unit 61 includes an impeller which is a rotating element or a rotor, and the outside air guided into the air intake port 66 during the rotation of the impeller is discharged from the discharge port 68 after the pressure thereof has been increased. The impeller is rotatable with the rotation of the engine rotary shaft 39 (FIG. 1) transmitted to the impeller. The compressing unit housing 71 is formed to represent a bowl shape. The air intake port 66 is opened in a shaft end portion of the compressing unit housing 71, which is opposite to the speed increasing unit 63, specifically on the left side thereof. The discharge port 68 is formed in an outer peripheral portion of the compressing unit housing 71 and is opened in a radial direction transverse to an axis of rotation of the supercharger, specifically on an upper side thereof. This discharge port 68 is disposed in the vicinity of the center of the widthwise direction (leftward and rightward direction) of the multicylinder combustion engine E and, accordingly, the unevenness of the intake air within the intake air chamber 74 is suppressed to thereby suppress variation in amount of the intake air supplied towards each of the cylinders.

The speed increasing unit 63 referred to above is operable to transmit the rotation of the engine rotary shaft 39 (shown in FIG. 1) to the impeller, and includes a gear group for transmitting to the impeller the outputted rotation which has been enhanced. Accordingly, the impeller can be rotated at a high speed. The supercharger casing 67 includes a support unit for rotatably supporting the impeller and the gear group. The compressing unit 61 and the speed increasing unit 63 are connected in a fashion axially aligned with each other on the same axis C and, therefore, the amount of projection of the supercharger casing 67 from the crankcase 40 is made small. The details of each of the compressing unit 61 and the speed increasing unit 63 will be described later.

The casing main body 69 referred to above includes a speed increasing unit storage 75 for accommodating therein the speed increasing unit 63 and a drum storage 77 for accommodating therein a change drum 108 (best shown in FIG. 5) as will detailed later. The casing main body 69 is supported by the upper surface 40*a* of the crankcase 40 in a fashion with the drum storage 77 and the speed increasing unit storage 75 juxtaposed relative to each other in a direction parallel a forward and rearward direction. The compressing unit housing 71 referred to previously has a portion thereof protruding downwardly of an undersurface 69*d* of the casing main body 69, as shown in FIG. 3, in a condition connected with a left end of the speed increasing unit storage 75 of the casing main body 69.

The upper surface 40*a* of the crankcase 40 is formed with an opening 150, and this opening 150 is closed by the casing main body 69 then supported by the upper surface 40*a* of the crankcase 40. In other words, the casing main body 69 shown in FIG. 3 functions concurrently as a lid for the opening 150. As shown in FIG. 4, the opening 150 is defined in a portion of the crankcase 40 adjacent a right end of the latter and somewhat on an inner side of the right end portion of such crankcase 40. By so doing, the supercharger 62 can be easily disposed on the inner side.

Figure 3:
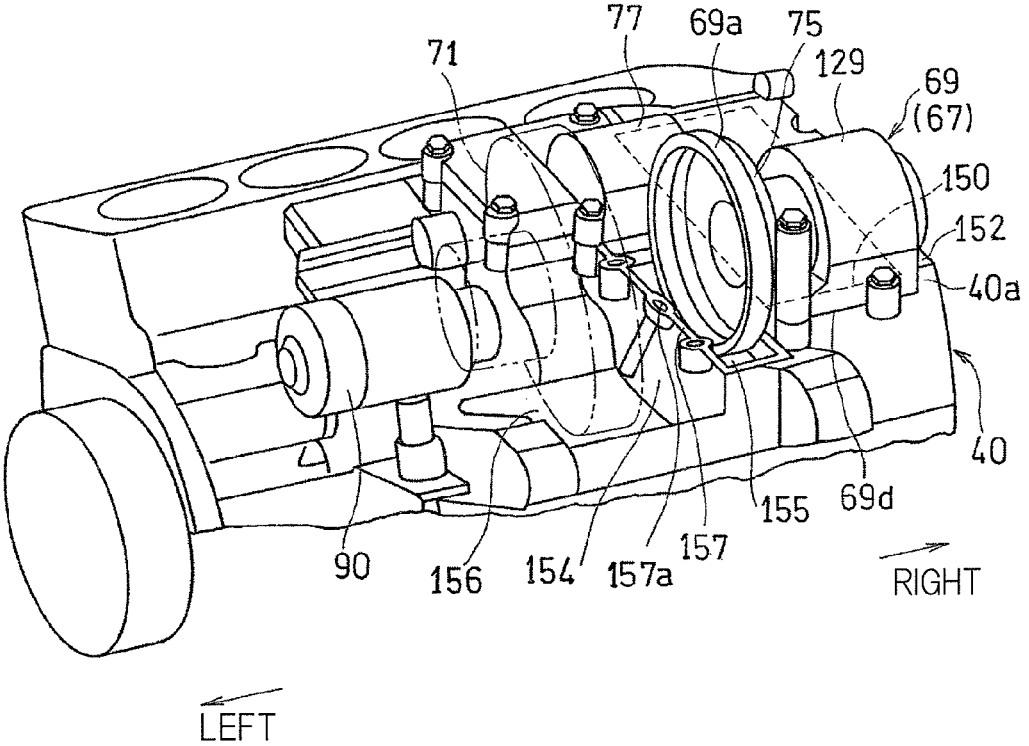
FIG. 3 is a perspective view of the engine, as viewed from rear, shown with a component on an upper portion of the engine removed.
Figure 4:
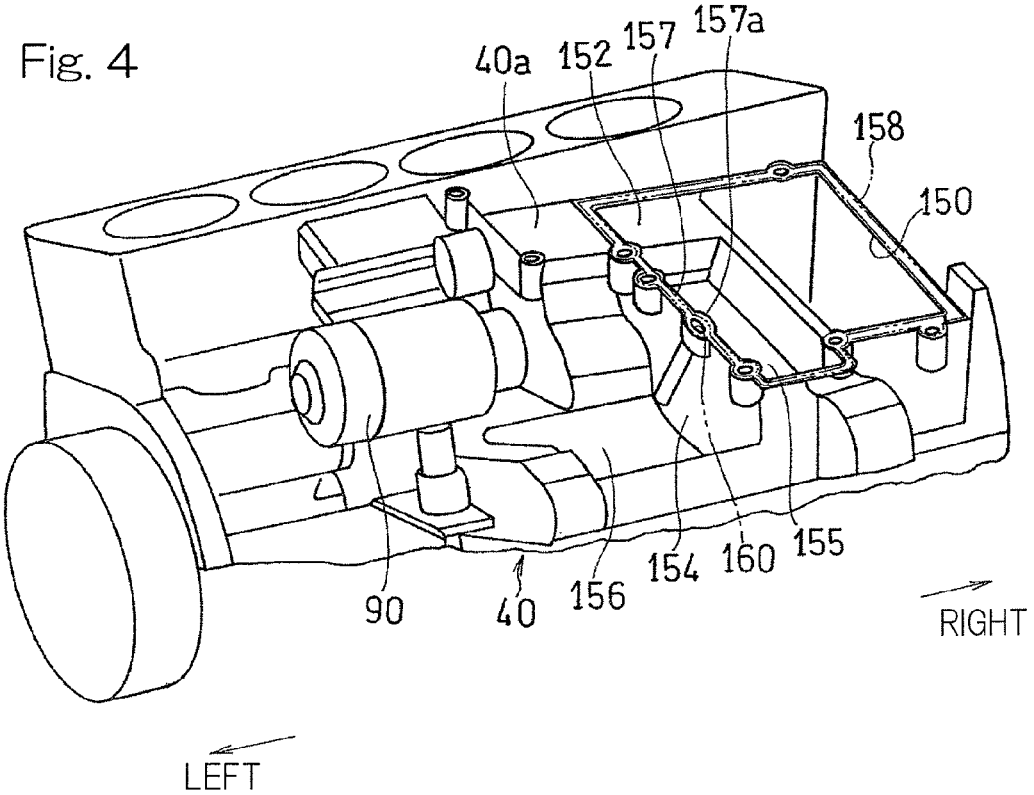
FIG. 4 is a view similar to FIG. 3, but with a main body casing of the supercharged removed.

As shown in FIG. 3, the upper surface 40*a* of the crankcase 40 includes an abutment surface area 152, with which the casing main body 69 is brought into abutment, and a first confronting surface area 154 axially confronting the compressing unit housing 71. The first confronting surface area 154 is positioned below the abutment surface area 152, and forms a stepped portion that is depressed at an angle of substantially 90° from the abutment surface area 152. This upper surface 40*a* of the crankcase 40 also includes an extension surface area 158 extending from the first confronting surface area 154 towards one side opposite to the abutment surface area 152 (left side as viewed in FIG. 3) in a direction axially of the supercharger rotating shaft 64. Accordingly, the extension surface area 156 is also positioned below the abutment surface area 152 together with the first confronting surface area 154.

The speed increasing unit storage 75 of the casing main body 69 includes a cylindrical casing flange 69*a* formed at a junction with the compressing unit housing 71, and a second confronting surface area 155 confronting the casing flange 69*a* in the upper surface 40*a* of the crankcase 40 is downwardly depressed also from the abutment surface area 152. Within the casing flange 69*a*, a planetary gear device (shown in FIG. 6) as will be described later is accommodated. In a partition wall 157 between the first confronting surface area 154 and the second confronting surface area 155, an oil port 157*a* open upwardly is formed. This oil port 157*a* is communicated with an oil passage through which a lubricant oil is supplied to the supercharger 62 and the planetary gear device 112.

As shown in FIG. 4, between the casing main body 69 (shown in FIG. 3) and the upper surface 40*a* of the crankcase 40 is sealed by a single frame-like sealing member 158. This sealing member 158 is made of, for example, a rubber plate. With this, a sealing structure is simplified. A portion of the sealing member 158, which corresponds to the oil port 157*a*, is formed with a throughhole 160 forming a part of the oil passage. Accordingly, leakage of the oil can be effectively avoided.

Figure 5:
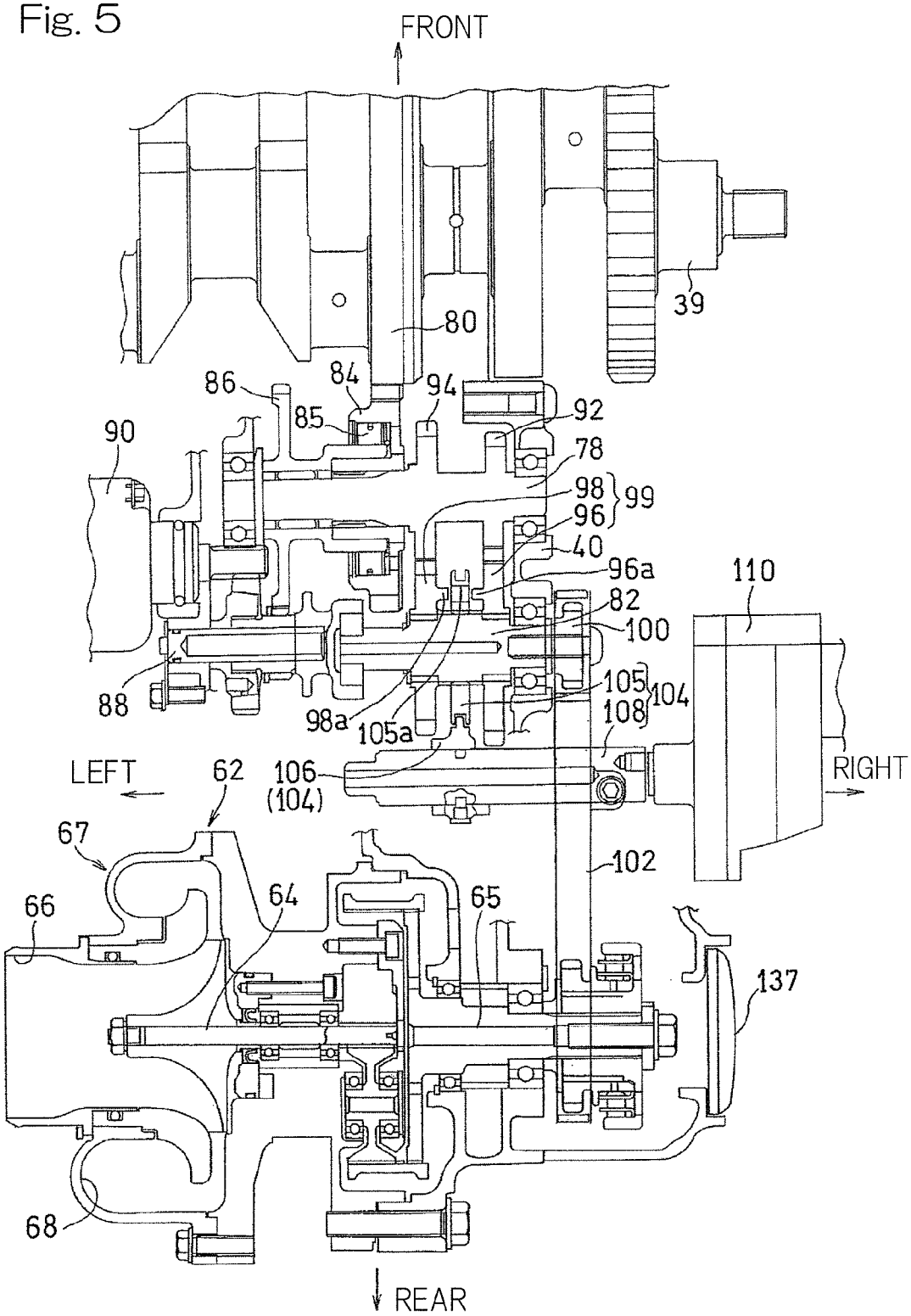
FIG. 5 is a diagram showing the arrangement of components in a drive system of the supercharger.

As shown in FIG. 5, the crankshaft 39, which is a rotary shaft of the combustion engine E, has a crank gear 80 provided thereon for driving a countershaft 78 having an axis parallel to the crankshaft 39, and a supercharger drive shaft 82 is disposed on one side opposite to the crankshaft 39 relative to the counter shaft 78. The countershaft 78 and the supercharger drive shaft 82 are supported by the crankcase 40. A drive gear 84 meshed with the crank gear 80 of the crankshaft 39 is spline-connected to the countershaft 78 for rotation together therewith. A starter gear 86 is relatively rotatably supported by the countershaft 78, and one way clutch 85 is interposed between the drive gear 84 and the starter gear 86.

A starter motor 90 is connected with the starter gear 86 through a torque limiter 88. Accordingly, when the starter motor 90 is rotated in a condition in which the combustion engine E is halted, the one way clutch 85 is coupled so that a start torque is transmitted to the crankshaft 39. Also, when the rotational speed of the crankshaft 39 becomes lower than that of the starter motor 90 subsequent to the start of the combustion engine E, the one way clutch 85 is decoupled to inhibit the power transmission from the crankshaft 39 to the starter motor 90. Since the starter motor 90 is, as shown in FIG. 3, disposed adjacent to the drum storage 77 of the supercharger casing 67 in a direction conforming to a leftward and rightward direction, it is possible to avoid interference between the starter motor 90 and the supercharger casing 67. Also, a balancer shaft (not shown) is disposed above the countershaft 78, and a balancer gear (also not shown) engageable with the drive gear 84 is relatively non-rotatably provided on the balancer shaft.

As shown in FIG. 5, a first speed change gear 92 of a reduced diameter and a second speed change gear 94 of a large diameter are fixed to the countershaft 78 by means of, for example, integral formation. Although in the illustrated embodiment the number of the speed change gears is two, it may be three or more. On the supercharger drive shaft 82, a third speed change gear 96 of a large diameter and a fourth speed change gear 98 of a reduced diameter, which are meshed with the first speed gear 92 and the second speed gear 94, respectively, are provided. The third and fourth speed change gears 96 and 98 are rotatable relative to the supercharger drive shaft 82 and are immovable in the axial direction relative to the supercharger drive shaft 82. Those third and fourth speed change gears 96 and 98 cooperate with each other to form a switching mechanism 99 for changing the power path of the supercharger 62.

Also, a sprocket 100 is provided on a right side end portion of the supercharger drive shaft 82 and, through a power transmitting body 102, which is in the form of a stripe shaped endless transmitting member and is operable to transmit the power of the combustion engine to the supercharger 62, a rotational force of the supercharger drive shaft 82, that is, a rotational force of the crankshaft 39 is transmitted to the input shaft 65 coupled with the supercharger rotating shaft 64. In the embodiment now under discussion, the power transmitting body is shown and described as employed in the form of a chain 102. The method of driving the supercharger 62 is not necessarily limited to that described above.

The chain 102 referred to above is disposed on the right side, which is opposite to the air intake port 66 of the supercharger 62, shown in FIG. 2, in the motorcycle widthwise direction and a cam chain tunnel 41 is disposed. Accordingly, even where the chain 102 is disposed in the vicinity of an outer end portion (right end portion) of the cylinder block 42, a forward cam chain tunnel 41 protrudes towards the right side and, therefore, the amount of projection of the supercharger 67 from the cylinder block 42 in a rightward direction can be suppressed. In the embodiment now under discussion, as shown in FIG. 5, the countershaft 78 and the supercharger drive shaft 82 are connected directly with each other, but they may be connected indirectly with each other through, for example, an idle gear. The details of the supercharger 62 will be described later.

Between the third speed change gear 96 and the fourth speed change gear 98 both on the supercharger drive shaft 82, a shifter 104 is disposed. The shifter 104 includes a shift ring 105, a shift fork 106 for operating the shift ring 105, and a change drum 108 for moving the shift fork 106 in parallel to the supercharger drive shaft 82. With the shift ring 105 splined to the supercharger drive shaft 82, the shift ring 105 is rendered to be non-rotatable relative to, but axially movable relative to the supercharger drive shaft 82.

The change drum 108 moves the shift fork 106 in the axial direction, having been rotationally driven by a shifter drive unit 110, to enable an engagement hole 105*a* of the shift ring 105 to be engaged with one of dogs 96*a* and 98*b* provided respectively in the third and fourth speed change gears 96 and 98. Thereby, the shift ring 105 is selectively and relatively non-rotatably engaged with one of the third and fourth speed change gears 96 and 98.

Through the selected speed change gear 96 and 98, the power is transmitted from the countershaft 78 to the supercharger drive shaft 82. In other words, when a dogged connection establishes between the shift ring 105 and the third speed change gear 96, the rotation of the countershaft 78, that is, the rotation of the crankshaft 39 is transmitted to the supercharger drive shaft 82 at a large speed increasing ratio. On the other hand, when a dogged connection establishes between the shift fork 106 and the fourth speed change gear 98, the rotation of the countershaft 78 is transmitted to the supercharger shaft 82 at a small speed reducing ratio. Also, so long as no dogged connection establish, no transmission of the power to the supercharger shaft 82 takes place. The shifter drive unit 110 used is of a type employing, for example, a servomotor, but it is not necessarily limited thereto. Accordingly, the rotational force of the crankshaft 39 is transmitted from the countershaft 78 to the supercharger drive shaft 82 of the supercharger 62 through the selected speed gear 96 or 98.

The shifter dive unit 110 causes the shift fork 106 in the axial direction of the change drum 108 in dependence on, for example, the number of rotations of the combustion engine E to allow one of the third and fourth speed change gears 96 and 98, which is appropriate to the number of rotations, to be selected. Specifically, at a low rotational region of the combustion engine E, setting is made that the shift ring 105 is in a dogged connection with the third speed change gear 96 to increase the speed increasing ratio of the supercharger 62 to thereby increase the supercharger pressure, that is, the amount of air supercharged so that the engine torque at a low speed can be earned. On the other hand, at a high rotational region of the combustion engine E, setting is made that the shift ring 105 is in a dogged connection with the fourth speed gear 98 to lower the speed increasing ratio of the supercharger 62 to thereby prevent the amount of air supercharged from increasing excessively so that a proper engine torque and a stabilized rotation can be obtained. Also, where no supercharging is required, the shift fork 106 is moved to a position at which no dogged connection establishes.

Figure 6:
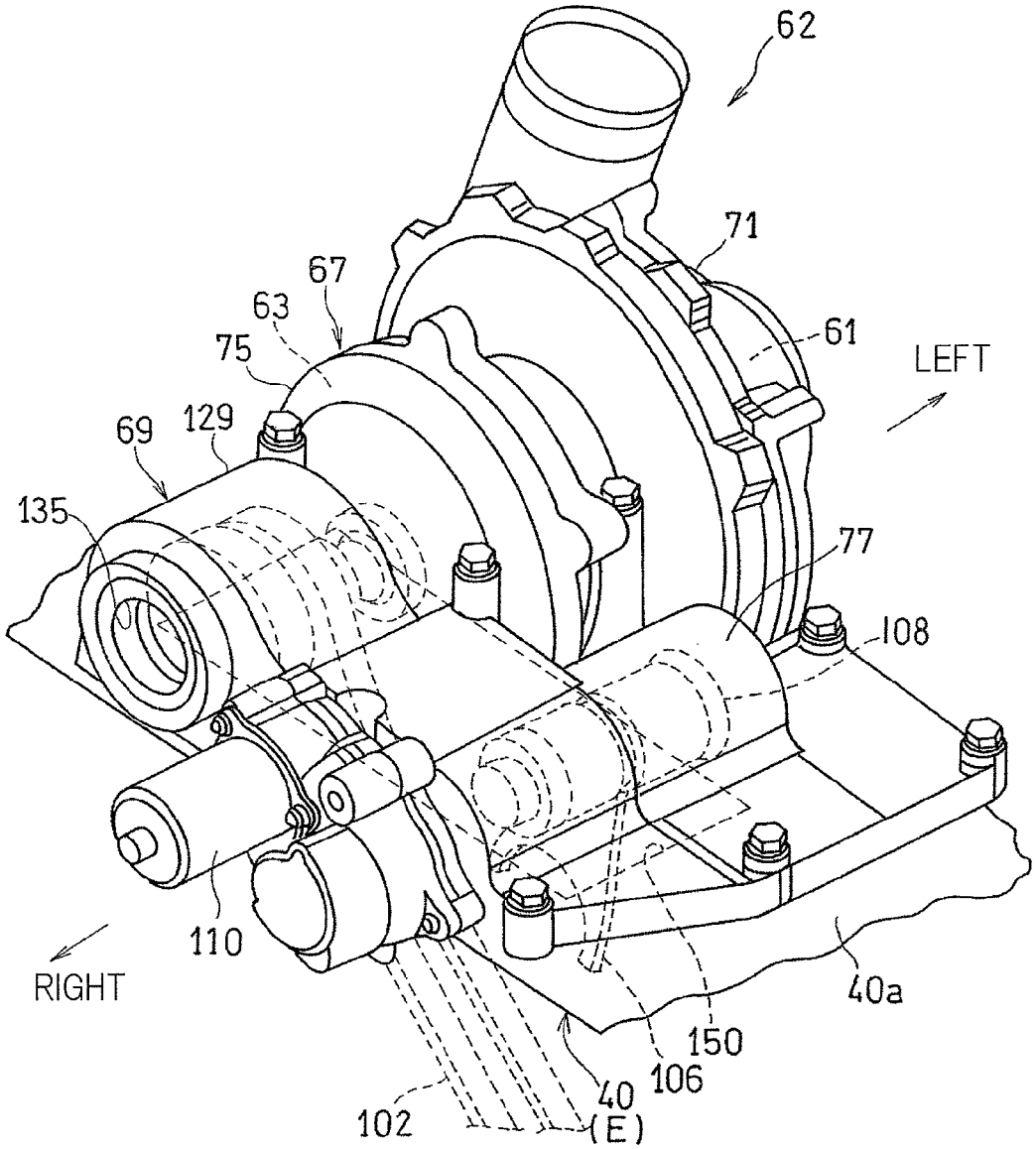
FIG. 6 is a perspective view showing the supercharger.

FIG. 6 illustrates an assembled condition of the supercharger 62. As shown therein, the chain 102 referred to above extends having been passed completely through the top opening 150. Also, the change drum 108 is accommodated within the supercharger casing 67, and the shift fork 106 extends having been passed through the opening 150 in the upper portion of the crankcase 40. In other words, the chain 102 and the shift fork 106 are partially exposed from the top opening 150 of the crankcase 40 and are disposed over both of the crankcase 40 and the casing main body 69.

In the embodiment now under discussion, the change drum 108 is shown as disposed above the top opening 150, but the change drum 108 may be disposed at a position at which it traverses the top opening 150. Also, the shifter drive unit 110 is removably fitted to an outer surface of the supercharger casing 67. In this way, the assembly of the supercharger 62 including the compressing unit 61, the speed increasing unit 63, a compressor casing 67, the shift fork 106, the change drum 108, the shifter drive unit 110, etc. is formed.

Figure 7:
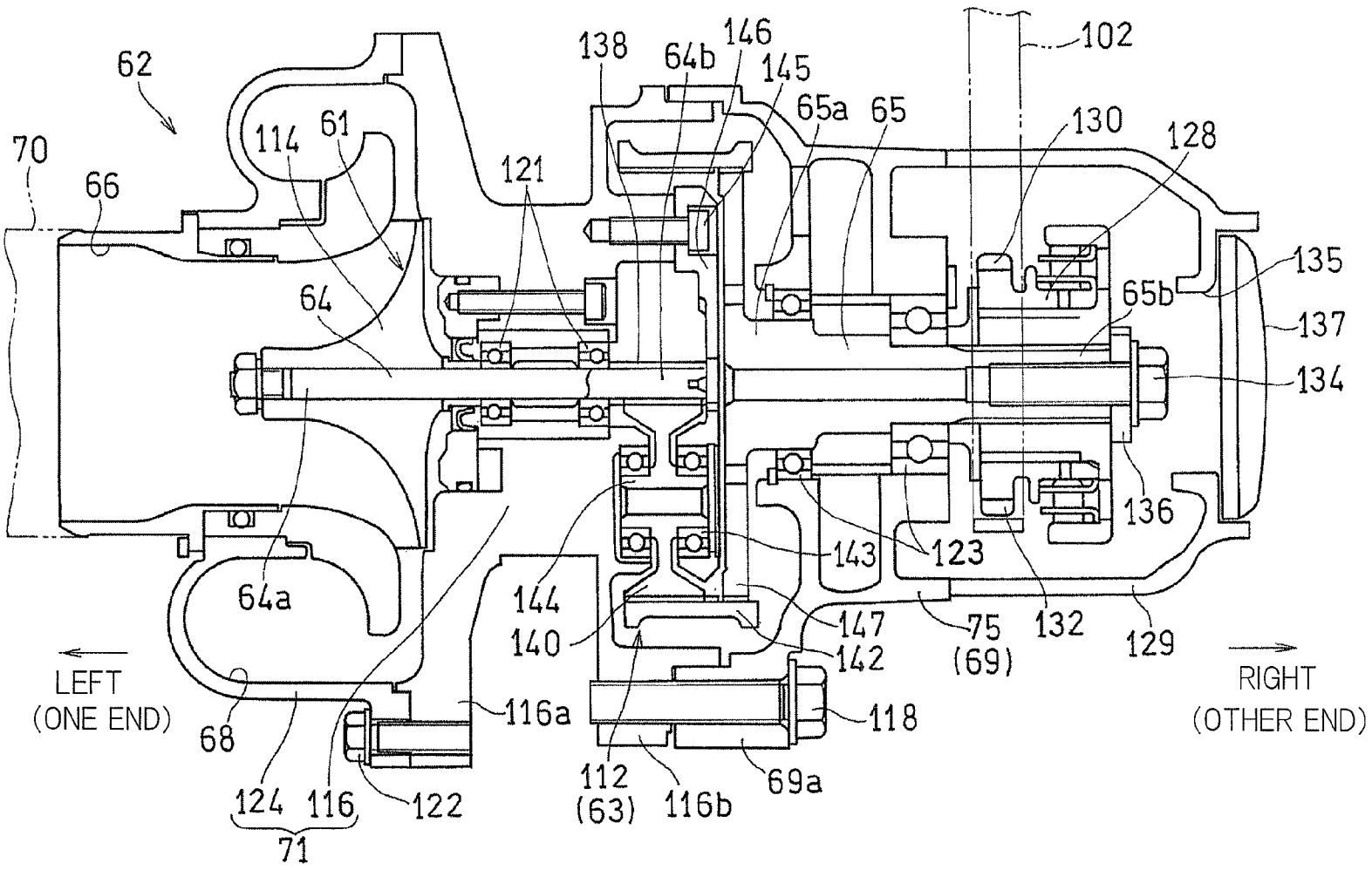
FIG. 7 is a horizontal sectional view showing the supercharger.

FIG. 7 shows a horizontal sectional view of the supercharger 62. As shown in FIG. 7, one end portion 64*a* of the supercharger rotating shaft 64 is fixed with an impeller 114, which is the impeller of the compressing unit 61, and one end portion 65*a* (the right side of the motorcycle widthwise direction) of the input shaft 65 of the speed increasing unit 63 is connected with the other end portion 64*b* of the supercharger rotating shaft 64 through the planetary gear device 112 which is the speed increasing unit 63. Hereinafter, one end side of the supercharger 62 is referred to as a left side of the motorcycle widthwise direction and the other end side thereof is referred to as a right side of the motorcycle widthwise direction.

The compressing unit housing 71 includes a casing portion 116 for rotatably supporting the supercharger rotating shaft 64 through bearings 121. Using a casing fastening member 122 such has, for example, bolts, a housing portion 124 for enclosing the impeller 114 is fitted to a first flange 116 on one end side of the casing portion 116. A second flange 116*b* at the other end side of the casing portion 116 is fixed to the casing flange 69*a* of the main body casing 69, supported by the crankcase 40, by means of the previously described housing fastening member 118. In other words, the bearings 121 form a support unit for the supercharger rotating shat 64.

In this way, the supercharger rotating shaft 64 and the bearings 121, which form its support unit, are enclosed by the casing portion 116, and the impeller 114 is enclosed by the housing portion 124. The housing portion 124 is formed with the intake port 66, which opens on the one end side, and the discharge port 68 which opens upwardly.

The input shaft 65 is in the form of a hollow shaft and is rotatably supported by the casing main body 69 through bearings 123. Spline serrations are formed on an outer peripheral surface of the other end portion 65*b* of the input shaft 65 and, through a one way clutch 128 mounted on the outer peripheral surface by means of the spline engagement, a sprocket 130 is connected with the input shaft 65. The chain 102 referred to previously is trained around teeth 132 of the sprocket 130, and the rotation of the supercharger rotating shaft 82 (shown in FIG. 5) is transmitted to the input shaft 65 through this chain 102.

Female threaded portion is formed on an inner peripheral surface of the other end portion 65*b* of the input shaft 65, and the one way clutch 128 is mounted on the other end portion 65*b* through a washer 136 by means of a bolt 134 threadingly engaged with this female threaded portion. The one way clutch 128, the sprocket 130 and the bolt 134 are all accommodated in a sprocket covering 129 that is jointed to the other end of the speed increasing unit storage 75 in the supercharger casing 67 shown in FIG. 6. The other end of the sprocket covering 129 is formed with an opening 135 open towards the outside of the motorcycle body, and this opening 135 is closed by a cap 137 (shown in FIG. 5).

As hereinbefore described, the planetary gear device 112 shown in FIG. 7 is interposed between the input shaft 65 and the supercharger rotating shaft 64, and is supported by the casing main body 69 and the casing portion 116. The other end portion 64*b* of the supercharger rotating shaft 64 is formed with an external threaded portion 138, and a plurality of planet gears 140 are, while being arranged in a circumferential direction, meshed with this external threaded portion 138. In other words, the external threaded portion 138 in the supercharger rotating shaft 64 functions as a sun gear of the planetary gear device 112. Also, the planetary gears 140 are meshed with an internal gear (ring gear) 142 of a large diameter on a radially outer side. The planetary gear 140 is rotatably supported by a carrier shaft 144 by means of a bearing 143 mounted on the other end portion of the casing portion 116.

The carrier shaft 144 has a fixture member 146, and this fixture member 146 is fixed to the casing portion 116 by means of a bolt 145. In other words, the carrier shaft 144 is fixed to the casing portion 116. An input gear 147 provided on the one end portion of the input shaft 65 is meshed with the internal gear 142. In this way, the internal gear 142 is meshed with the input shaft 65 so that it will rotate in the same direction as that of the input shaft 65 and, with the carrier shaft 144 fixed, the planetary gear 140 rotates in the same direction as that of the internal gear 142. The sun gear (external gear 138) is formed in the supercharger rotating shaft 64, which serves as the output shaft, and rotates in a direction counter to the direction of rotation of the planetary gears 140. In other words, the planetary gear device 112 increases the speed of rotation of the input shaft 65 and transmit it to the supercharger rotating shaft 64 in a direction counter to the input shaft 65.

When the combustion engine E rotates, the crankshaft 39 shown in FIG. 5 rotates and the countershaft 78 is rotated in driving association with the crankshaft 39 due to the meshed relation between the drive gear 84 and the crank gear 80. When the countershaft 78 rotates in this way, the supercharger drive shaft 82 rotates through a speed change device. When the supercharger drive shaft 82 rotates, the input shaft 65 is rotated via the chain 102, and further, the supercharger rotating shaft 64 rotates through the planetary gear device 112 to cause the supercharger 62 to be started.

When the motorcycle travels, the incoming wind passes from the air intake opening 38 and through the random duct unit 51 and, is, after having been purified by the air cleaner 55, introduced into the supercharger 62 by way of the air intake duct section 53. The incoming air A so introduced into the supercharger 62 is pressurized by the supercharger 62 and is then introduced into the combustion engine E through the intake air chamber 74 and the throttle body 76. By the cumulative effect of the ram pressure and the pressurization by the supercharger 62, the high pressure intake air can be supplied into the combustion engine E.

In the construction described hereinabove, within the supercharger casing 67 removable relative to the crankcase 40 of the combustion engine E as shown in FIG. 2, the compressing unit 61 and the speed increasing unit 63 of the supercharger 62 are accommodated. In other words, as shown in FIG. 6, since the supercharger 62 is constructed as a single assembly, the supercharger 62 can be easily mounted on or removed from the combustion engine E, and also tests with the single assembly of the supercharger 62 alone can be performed. Also, when the assembly is removed and the top opening 150 of the crankcase 40 is closed by a separate covering member, the engine E can be switched over to a type with no supercharger. In addition, since the chain 102 is used as a rotation transmitting member, the type of the supercharger 62 can be easily changed, and also it can be easily adopted to the type of the engine with no supercharger 62.

Also, since the chain 102 extends having been passed completely through the top opening 150 of the crankcase 40, even when the supercharger 62 is disposed above the crankcase 40, the power of the combustion engine E can be smoothly transmitted to the supercharger 62 by means of the chain 102 disposed at a position proximate to the supercharger 62 in the axial direction.

As shown in FIG. 7, since the compressing unit housing 71 and the casing main body 69 are formed separately, there is no need to have the impeller 114 accommodated within the casing main body 69 and the dimension in the up and down direction of the casing main body 69 as shown in FIG. 3, that is, the radial dimension thereof can be reduced.

Also, since the first confronting surface area 154 is formed beneath the abutment surface area 152, the amount of projection of the supercharger 62 in a direction upwardly from the crankcase 40 can be suppressed while the interference between the upper surface 40*a* of the crankcase 40 and the compressing unit housing 71 is avoided.

Furthermore, the upper surface 40*a* of the crankcase 40 is formed with the extension surface area 156 extending from the first confronting surface area 154 in a direction counter to the abutment surface area 152 (FIG. 5) in the axial direction of the supercharger rotating shaft 64 and, also, the extension surface area 156 is formed below the abutment surface area 152 together with the first confronting surface area 154. Therefore, the air intake duct 70 can be easily disposed on the extension surface area 156.

As shown in FIG. 7, since the bearings 121, which forms the support unit for the supercharger rotating shaft 64, are accommodated within the supercharger casing 67, the supercharger rotating shaft 64 is positioned upwardly of the upper surface 40*a* of the crankcase 40 shown in FIG. 3. Accordingly, even if the compressing unit housing 71, in which the impeller 114 is accommodated, is disposed above the crankcase 40, disposition of the compressing unit housing 71 above the first confronting surface area 154 is effective to avoid the interference between the compressing unit housing 71 and the crankcase 40 in the up and down direction while the amount of projection of the compressing unit housing 71 from the crankcase 40 is suppressed.

As shown in FIG. 6, since the change drum 108 is accommodated within the supercharger casing 67, assemblage of the change drum 108 can be further facilitated. Also, since the shift fork 106 extends having been passed completely through the top opening 150 of the crankcase 40, as compared with the case in which the shift fork 106 is disposed in a side surface of the crankcase 40, it is easy to dispose the change drum 108 and the shift fork 106 on an inner side of the combustion engine E with respect to the motorcycle widthwise direction.

Also, since the shifter drive unit 110 is removably fitted to the supercharger casing 67, the shift fork 106 can be inserted into the supercharger casing 67 in a condition prior to the fitting of the shifter drive unit 110 and, therefore, the assemblability increases. Yet, it can readily be adopted to the type of the engine with no supercharger 62.

Figure 8:
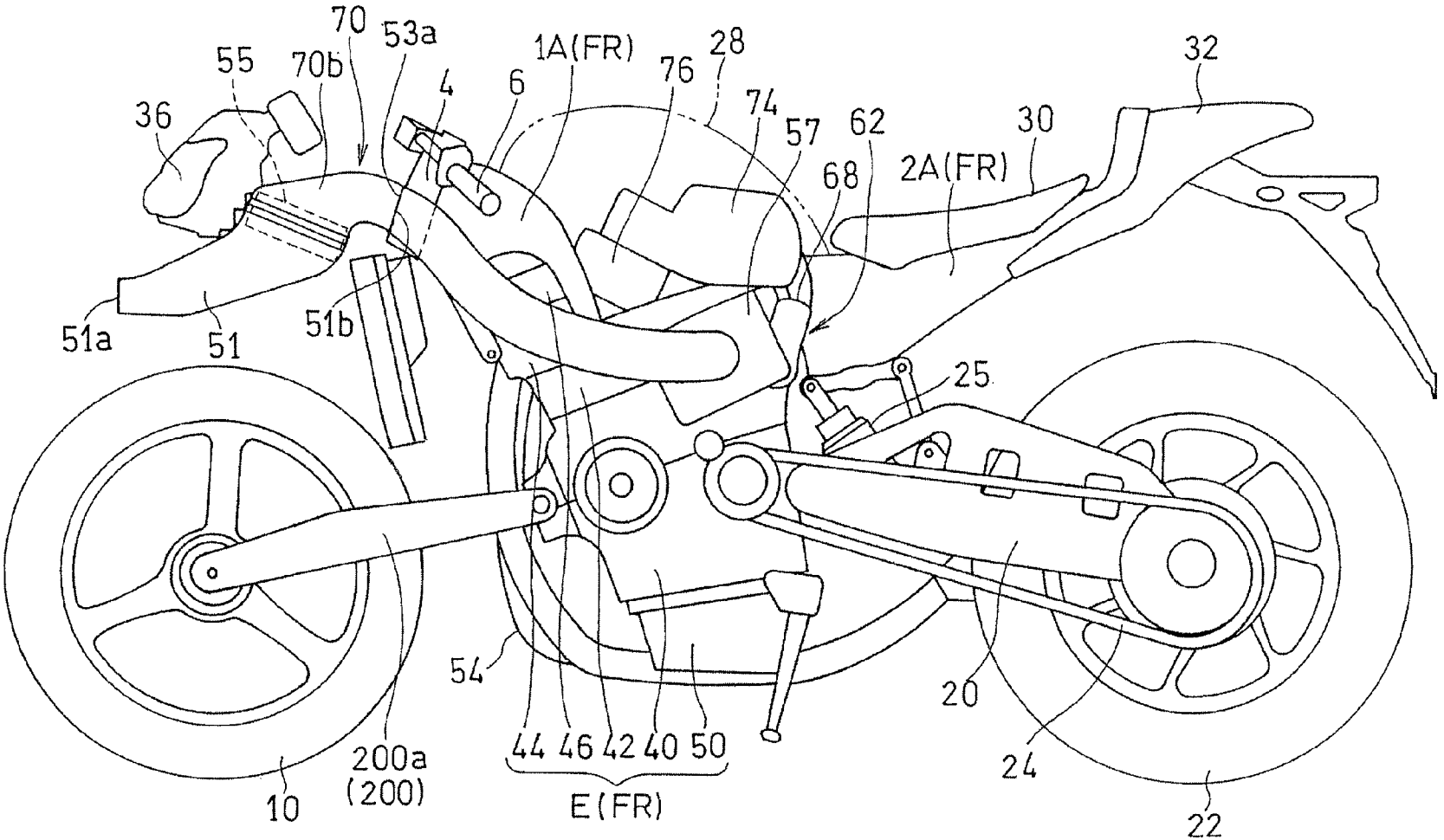
FIG. 8 is a side view showing a different example of the motorcycle equipped with the combustion engine.

FIG. 8 illustrates a side view showing a different motorcycle having the above described combustion engine E mounted thereon. The motorcycle frame structure FR used in this different motorcycle includes the combustion engine E disposed on an intermediate portion of the motorcycle body, a front frame 1A supported by the combustion engine E and extending diagonally upwardly and forwardly from the combustion engine E in the vicinity of the intermediate point with respect to the motorcycle widthwise direction, and a rear frame 2A supported by the combustion engine E and extending diagonally upwardly and rearwardly from the combustion engine E. In other words, the combustion engine E forms a part of the motorcycle frame structure FR.

The front frame 1A has a front end formed integrally with the head pipe 4, the steering shaft (not shown) is rotatably supported by this head pipe 4, and the steering handlebar 6 is fixed to this steering shaft. In other words, the head pipe 4 functions as a handlebar post, and the front frame 1A, which is a part of the motorcycle frame structure FR, extends from the head pipe 4 in a direction rearwardly of the motorcycle body. It is to be noted that in FIG. 8, the cowling 34 is not shown.

Forked arms 200 extending in a direction forwardly from the combustion engine E are supported by a front portion of the crankcase 40 of the combustion engine E for movement up and down. A hub steering mechanism (not shown) for steerably supporting the front wheel 10 is fitted to tip end portions of left and right pairs of arm pieces 200*a* and 200*b* of those arms 200. Also, there are provided a steering mechanism (not shown) for steering the front wheel 10 by means of the hub steering mechanism by transmitting the manipulation of the steering handle 6 and a front suspension (not shown) for cushioning in response to a load imposed on the front wheel 10. Other structural features than those described above are similar to those afforded by the previously described embodiment and, therefore, effects similar to those afforded by the previously described embodiment can be obtained.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, besides that employed in the embodiments shown and described, the present invention is applicable to a cradle frame, a diamond frame or a backbone frame. Also, the supercharger mounting structure can be equally applied to any other saddle-riding automotive vehicle than the motorcycle and is applicable to, for example, a three wheeled automotive vehicle or a four wheeled automotive vehicle. In addition, the present invention can be equally applied to anything other than the engine mounted on the automotive vehicle.

Also, in describing the preferred embodiment, the switching mechanism 99 has been shown and described as having the speed change ratio that is switchable, it may be so constructed as to switch between a neutral condition and a gear meshed condition. Yet, any other compressing structure than the impeller 114, which has been shown and described as forming the compressing unit 61, can be employed.

Accordingly, such changes and modifications are, unless they depart from the scope of the present invention as delivered from the claims annexed hereto, to be construed as included therein.

REFERENCE NUMERAL

39 . . . Engine rotary shaft (Crankshaft)
40 . . . Crankcase
61 . . . Compressing unit
62 . . . Supercharger
63 . . . Speed increasing unit
64 . . . Supercharger rotating shaft
67 . . . Supercharger casing
69 . . . Casing main body
71 . . . Compressing unit housing
82 . . . Supercharger drive shaft
99 . . . Switching mechanism (Speed change gear)
102 . . . Chain (Power transmitting member)
106 . . . Shift fork
108 . . . Change drum
110 . . . Shifter drive unit
150 . . . Upper opening of crankcase
152 . . . Abutment surface area
154 . . . First confronting surface area
156 . . . Extension surface area

What is claimed is:

1. A supercharger mounting structure for fitting a supercharger therethrough to an engine, the supercharger including:

a compressing unit to supply an intake air under pressure to the engine;

a speed increasing unit to increase the speed of rotation of an engine rotary shaft and then to transmit the increased rotation of the engine rotary shaft to the compressing unit; and a supercharger casing having the compressing unit and the speed increasing unit both accommodated therein, the supercharger casing being removably fitted to a crankcase of the engine, wherein the supercharger casing comprises:

a casing main body removably fitted to an upper surface of the crankcase; and a compressing unit housing configured to accommodate therein the compressing unit and connected to the casing main body by the use of a bolt, the compressing unit housing being provided with an air intake port of the supercharger, wherein:

the compressing unit includes an impeller which is fixed to a supercharger rotating shaft extending parallel to the engine rotary shaft; and the air intake port is formed in one side portion of the compressing unit housing, which is a side opposite to the speed increasing unit, and is opened outwardly of the engine.

2. The supercharger mounting structure for the engine as claimed in claim 1, wherein the crankcase has an upper portion provided with an opening, and a power of the engine is transmitted to the speed increasing unit by means of a power transmitting member that extends, having been passed completely, through the opening.

3. The supercharger mounting structure for the engine as claimed in claim 1, wherein the compressing unit includes a rotary shaft, which rotary shaft is supported by a support unit that is accommodated within the supercharger casing so that such rotary shaft of the compressing unit is disposed above the upper surface of the crankcase.

4. The supercharger mounting structure for the engine as claimed in claim 1, wherein the casing main body is disposed in one end portion, in a direction of extension of the engine rotary shaft, of the crankcase, which is an end portion opposite to the air intake port.

5. The supercharger mounting structure for the engine as claimed in claim 1, wherein the speed increasing unit comprises a planetary gear device.

6. A supercharger mounting structure for fitting a supercharger therethrough to an engine, the supercharger including:

a compressing unit to supply an intake air under pressure to the engine;

a speed increasing unit to increase the speed of rotation of an engine rotary shaft and then to transmit the increased rotation of the engine rotary shaft to the compressing unit; and a supercharger casing having the compressing unit and the speed increasing unit both accommodated therein, the supercharger casing being removably fitted to a crankcase of the engine, wherein;

the supercharger casing comprises a casing main body enclosing the upper portion of the crankcase and a compressing unit housing to accommodate therein the compressing unit;

the compressing unit housing has a portion which protrudes downwardly below an undersurface of the casing main body in a condition connected with the casing main body;

the crankcase has an upper surface including an abutment surface area, which is held in abutment with the casing main body, and a confronting surface area confronting to the compressing unit housing in a direction conforming to an axial direction of the supercharger;

the confronting surface area is formed below the abutment surface area;

the upper surface of the crankcase also includes an extension surface area extending from the confronting surface area in an axial direction of the compressing unit towards one side opposite to the abutment surface area; and the extension surface area is also formed together with the confronting surface area below the abutment surface area.

7. A supercharger mounting structure for fitting a supercharger therethrough to an engine, the supercharger including:

a compressing unit to supply an intake air under pressure to the engine;

a speed increasing unit to increase the speed of rotation of an engine rotary shaft and then to transmit the increased rotation of the engine rotary shaft to the compressing unit; and a supercharger casing having the compressing unit and the speed increasing unit both accommodated therein, the supercharger casing being removably fitted to a crankcase of the engine, wherein;

a drive shaft drivingly connected with the engine rotary shaft to drive the supercharger is supported by the crankcase;

a switching mechanism to switch a power path of the supercharger is mounted on the drive shaft; and a change drum operable to actuate the switching mechanism through a shift fork is accommodated within the supercharger casing.

8. The supercharger mounting structure of the engine as claimed in claim 7, wherein the shift fork extends, having been passed, through the opening formed in the upper portion of the crankcase.

9. The supercharger mounting structure for the engine as claimed in claim 7, further including a shifter drive unit to drive the change drum, the shifter drive unit being removably fitted to the supercharger casing.

10. A supercharger mounting structure for fitting a supercharger therethrough to a combustion engine, the supercharger including:

a compressing unit to supply an intake air under pressure to the engine;

a speed increasing unit to increase the speed of rotation of an engine rotary shaft and then to transmit the increased rotation of the engine rotary shaft to the compressing unit; and a supercharger casing having the compressing unit and the speed increasing unit both accommodated therein, the supercharger casing being removably fitted to a crankcase of the engine, wherein;

the supercharger is driven by a power of the combustion engine via a power transmitting member;

an input shaft of the speed increasing unit has an end portion with which a sprocket is connected;

the sprocket includes teeth around which the power transmitting member is trained;

the sprocket is accommodated within a sprocket covering which is jointed to the supercharger casing;

the sprocket covering is formed with an opening open towards the outside; and the opening is closed by a cap.

* * * * *